United States Patent [19]

Cigognetti

[11] 4,329,751

[45] May 18, 1982

[54] INFLATABLE BOAT

[76] Inventor: Edoardo Cigognetti, Via della Repubblica, 19, Senago (Milano), Italy

[21] Appl. No.: 165,021

[22] Filed: Jul. 1, 1980

[30] Foreign Application Priority Data

Jul. 25, 1979 [IT] Italy ..... 24621 A/79

[51] Int. Cl.[3] ..... B63B 7/08

[52] U.S. Cl. ..... 114/345; 114/355; 441/40

[58] Field of Search ..... 114/56, 61, 219, 88; 9/2 A, 6 R, 11 A; 24/201 LP, 201 A, 203 R

[56] References Cited

U.S. PATENT DOCUMENTS

| | | | |
|---|---|---|---|
| 2,669,733 | 2/1954 | Picker | 9/1.6 |
| 3,103,050 | 9/1963 | Reitmeier | 24/203 |
| 4,186,820 | 2/1980 | Cosman et al. | 9/1.6 X |
| 4,251,893 | 2/1981 | McCrory et al. | 9/11 A |

FOREIGN PATENT DOCUMENTS

| | | | |
|---|---|---|---|
| 725463 | 1/1966 | Canada | 209/403 |
| 1431128 | 1/1966 | France | 9/11 A |
| 2375085 | 8/1978 | France | 9/2 A |
| 647171 | 2/1979 | U.S.S.R. | 9/2 A |

*Primary Examiner*—Ralph J. Hill
*Attorney, Agent, or Firm*—Young & Thompson

[57] ABSTRACT

An inflatable boat has a pair of elongated inflatable side portions extending lengthwise of the boat, disposed within an envelope that can be opened and closed by longitudinally-extending openings on its outer side, to permit insertion and removal of inflatable chambers. The margins of the envelope openings are maintained closed by interfitting loops, each loop receiving a slotted pin with the head and tail of the pin projecting from opposite sides of the loop, so that the pins of the loops associated with one margin of the opening interfere with the heads and tails of the pins projecting from the loops associated with the other margin of the opening, thereby to hold the margins together. A rigid panel at the stern of the boat supports an outboard motor, and is detachably secured between the side members by special screw assemblies. At the prow of the boat, relatively vertically swingable panels provide a deck in one position and the support for a short ladder in another position.

6 Claims, 26 Drawing Figures

Fig. 21
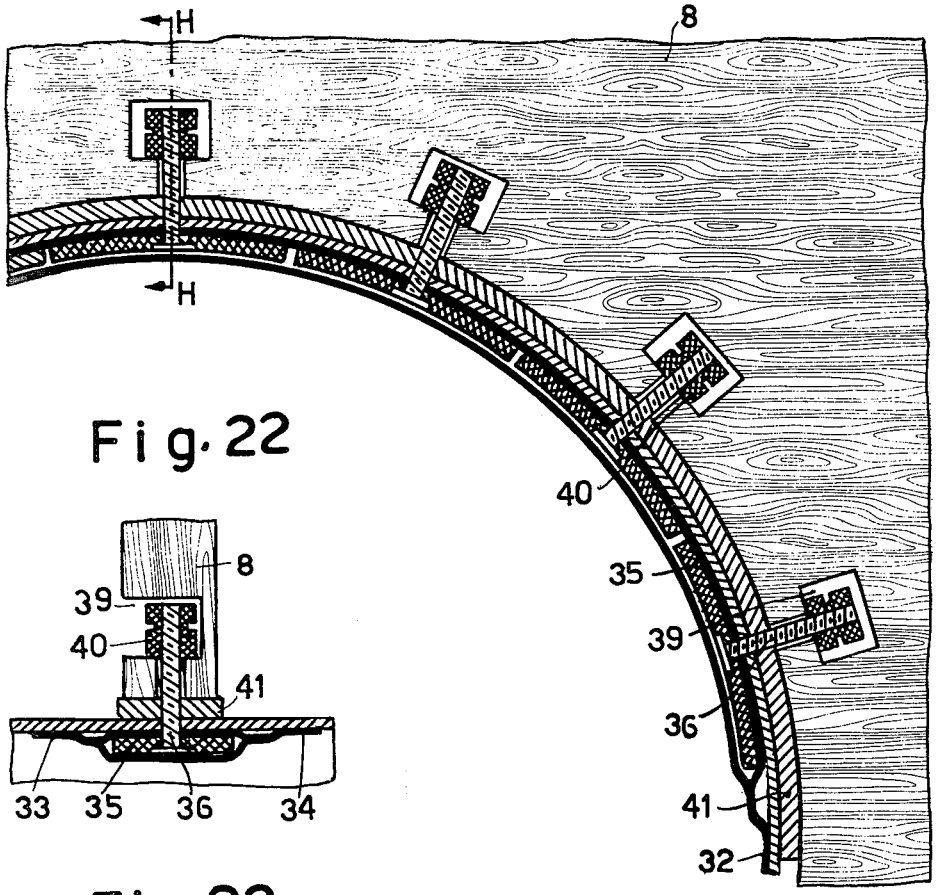
Fig. 22
Fig. 23
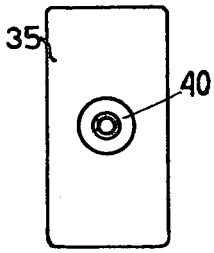

INFLATABLE BOAT

The present invention relates to inflatable boats of relatively large size, for example those adapted to transport six persons or more, or loads of comparable weight, and to be used in relatively deep water as well as to be propelled by outboard motors. Such boats have to withstand bumps and abrasions from rocks or other sharp obstacles and are ordinarily comprised by a floating body which includes chambers inflatable with air under pressure and which chambers are disposed within a shielding envelope that protects them.

It is known to provide such inflatable boats with openings that extend lengthwise of the shielding material, through which the inflatable air chambers can be inserted and removed. The margins of these longitudinal openings can then be secured together by laces or the like.

It is also known to provide a stern for such boats, in the form of a rigid upright panel to support the outboard motor. Such stern is generally fixed to the covering by cementing or plastic welding or the like.

In the past, the opening and closing of the longitudinal openings through the shielding material, for the induction or removal of the inflatable air chambers, has been extremely laborious and it has been difficult to tighten the covering material over these air chambers. Moreover, the emplacement of a rigid stern on such boats has been a difficult and quite expensive operation, as it has been necessary to provide seats of flexible material in which the panel can be secured. It has also been difficult to hold the panel securely to the boat in the sense of tightening the panel on the boat, which is necessary if an outboard motor is to be mounted on the panel.

It is accordingly an object of the present invention to overcome these difficulties of known inflatable boats, by providing a protective envelope for the air chambers, which has fastening means which not only are easy to use and secure in use, but also serve to prevent shock and abrasion and to protect the boat upon lateral contact with rigid obstacles.

These objects are achieved, according to the present invention, by providing a floating body composed of two parts of substantially cylindrical or slightly frustoconical form and having their longitudinal axes substantially parallel. These two parts are prolonged and joined at the forward end or prow, with another portion of trapezoidal or semicircular buoyant body cover which is slightly inclined upwardly. The outer walls of the envelope are provided with long straight apertures having closure means including a series of spaced apart elements of flexible material secured to the material of the cover, and cylindrical pins of substantially rigid material that penetrate these elements to hold the edges of the opening together.

The present invention also comprises an inflatable boat in which the rigid panel that supports the outboard motor is fixed to the covering with screws whose heads are disposed within the cover and which project outwardly to receive, on each side of the boat, corresponding screwthreaded fastenings carried by the panel that is to support the outboard motor.

Another feature of the present invention is the provision of a swingable platform with attached short ladder, at the prow of the boat, which can be quickly let down into the water.

Other objects, features and advantages of the present invention will become apparent from a consideration of the following description, taken in connection with the accompanying drawings, in which:

FIG. 21 is a cross-sectional view of the assembled parts shown in FIG. 20, in a plane perpendicular to the axis of the inflatable chambers;

FIG. 22 is a cross-sectional view taken on the line H—H of FIG. 21;

FIG. 23 is a bottom plan view of one of the screws and its mounting plate, as used in the embodiment of FIGS. 20–22;

In the drawings, the same parts in the various views have the same reference numerals.

Figure 1:
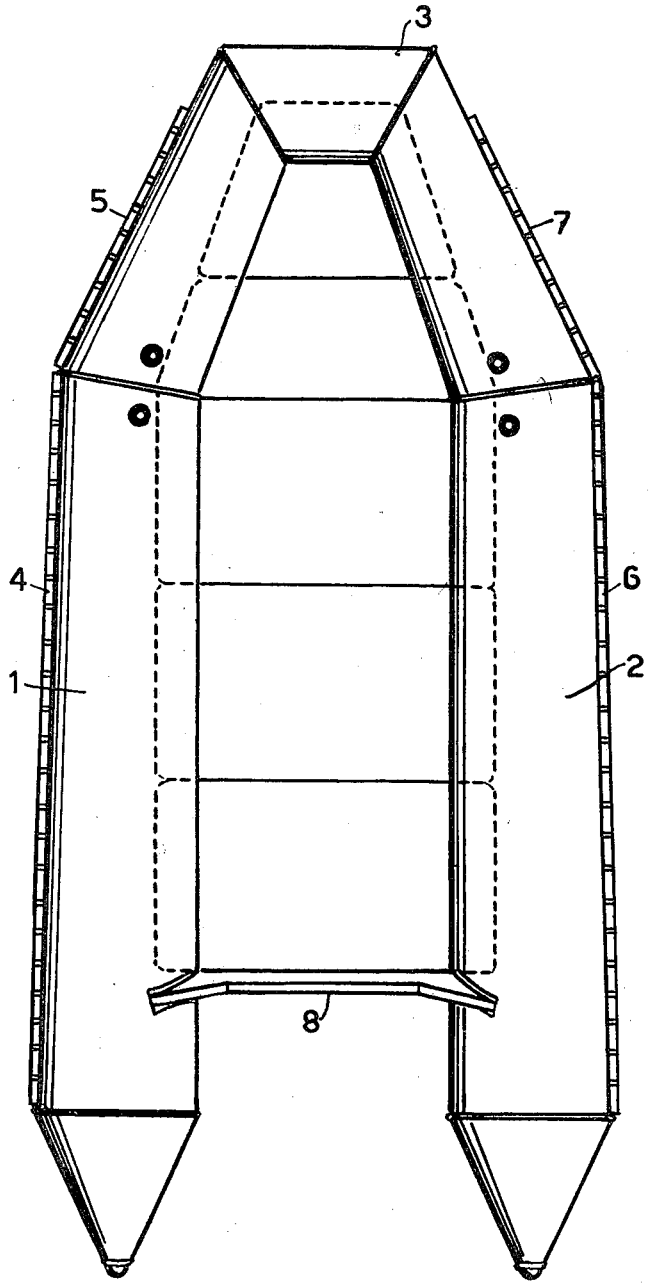
FIG. 1 is a top plan view of an inflatable boat according to the present invention.
Figure 2:
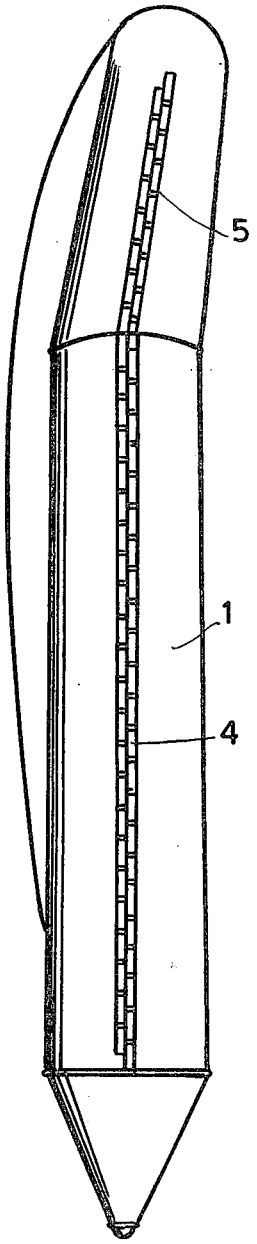
FIG. 2 is a side elevational view thereof.
Figure 3:
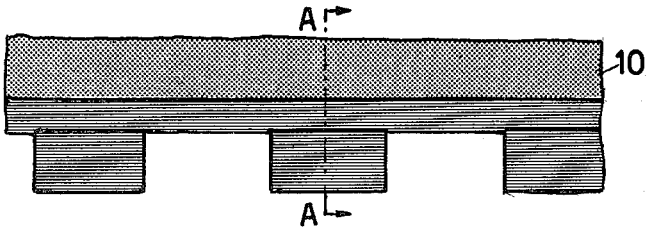
FIG. 3 is an enlarged fragmentary view of one margin of the opening through the cover of the boat according to the present invention.
Figure 5:
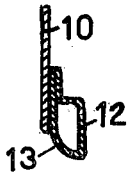
FIG. 5 is a cross-sectional view on the line A—A of FIG. 3.
Figure 4:
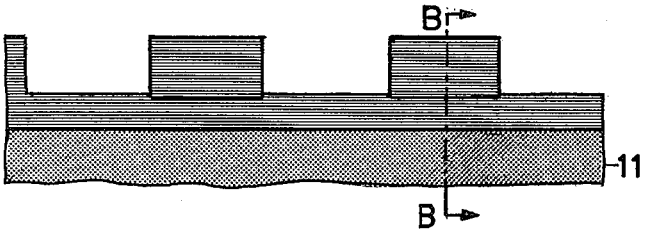
FIG. 4 is a view similar to FIG. 3, but showing the opposite margin of the opening through the cover.
Figure 6:
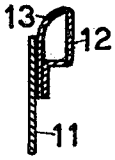
FIG. 6 is a cross-sectional view on the line B—B of FIG. 4.

Referring now to the drawings in greater detail, and first to FIGS. 1 and 2 thereof, there is shown an inflatable boat which comprises a flexible covering of heavy water-resistant material (for example, synthetic resincoated or rubber-coated cloth), comprised by two portions 1 and 2 of substantially cylindrical or slightly frusto-conical form, having their axes parallel to each other and extending lengthwise of the boat. Parts 1 and 2 are joined at the prow of the boat by another part 3 having a trapezoidal or semi-circular shape. In the interior of the covering, three air chambers (not visible in FIGS. 1 and 2) are contained, which can be withdrawn from the envelope through long longitudinally extending openings at each side of the covering. The borders of these openings are closed by closure means 4, 5, 6 and 7, which will be discussed in greater detail hereinafter.

At the stern of the boat, a rigid upright panel 8 of wood or the like is provided, which supports an outboard motor (not shown) and which is connected with the covering envelope of the boat by means of devices characteristic of this invention and which will be described in detail.

The closure devices, which are secured to the borders 10 and 11 of the longitudinal openings by cementing or heat-welding or the like, each includes a series of strip-like elements of flexible material which are so disposed as to resemble Grecian fret-work or crenelation.

Figure 7:
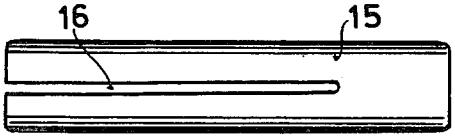
FIG. 7 is a view of one of the cylindrical pins that holds the marginal edges of the cover opening together.
Figure 8:
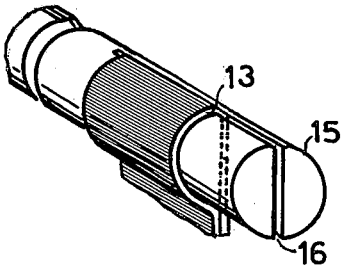
FIG. 8 is a perspective view of the pin of FIG. 7 in use.
Figure 9:
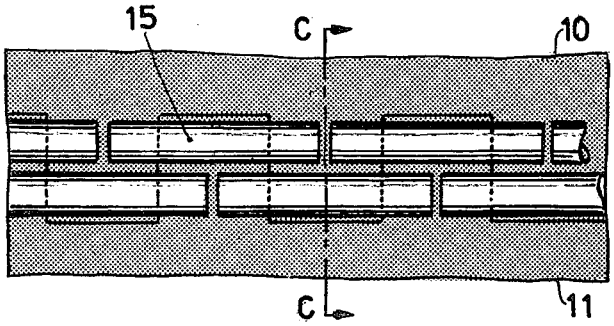
FIG. 9 is a fragmentary assembly view showing the two edges of the margins of the opening of the cover stitched together with the pins of FIG. 7.
Figure 10:
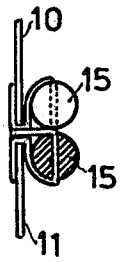
FIG. 10 is a cross-sectional view on the line C—C of FIG. 9.
Figure 11:
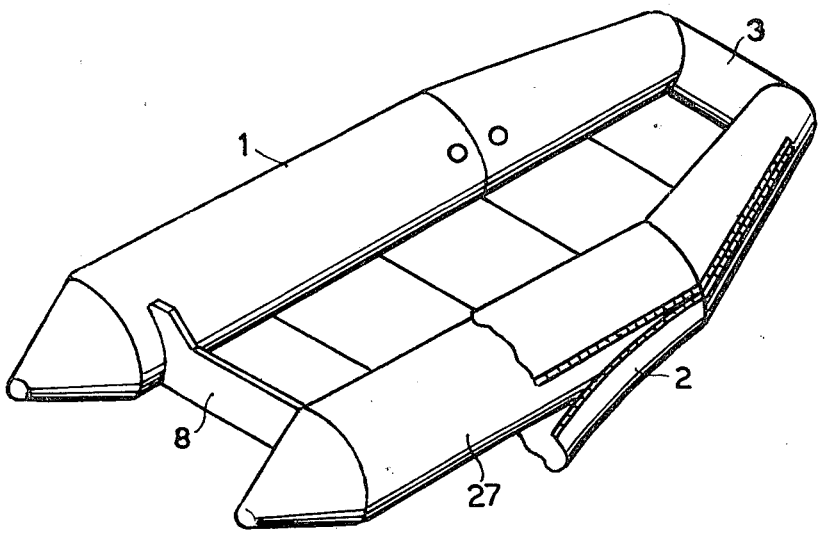
FIG. 11 is a perspective view of the boat with the cover partially open and partially removed.
Figure 12:
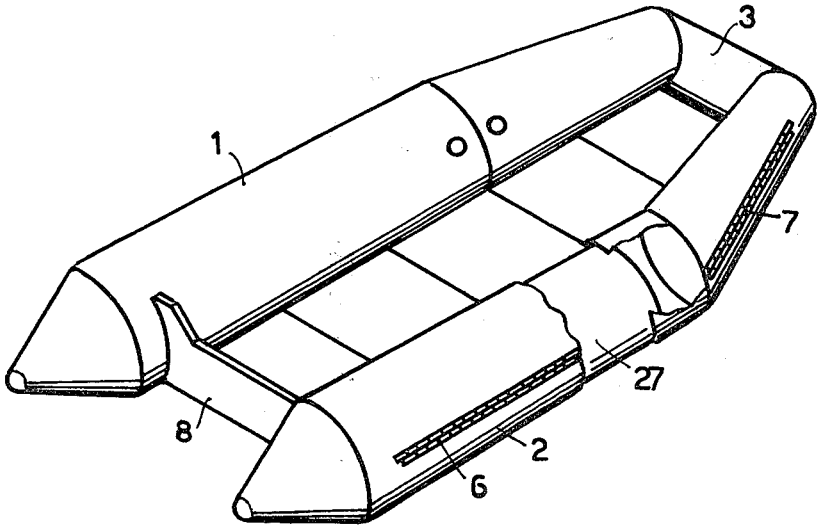
FIG. 12 is a view similar to FIG. 11, but showing another portion of the cover broken away.

Each of the projecting members is in the form of a loop of material having a straight portion 12 and an arcuate portion 13. Pins 15 are slotted at 16 as best seen in FIG. 7, and are insertable in these loops as seen in FIGS. 8–10, with the straight portion 12 in the slot 16 and the curved portion 13 on the outside of the pin. The length of slot 16 is a little less than one and one-half times the width of a loop, so that when the pins are inserted in the assembled relationship shown in FIGS. 9 and 10, with the unslotted heads of the pins toward the prow of the boat, which is to the left in FIG. 9, then the head and tail of each pin will protrude from opposite ends of a loop and have interference with the head and tail of two different pins in the adjacent but oppositely extending loops. This relationship is best seen in FIG. 9. As a result, the interference between the pins 15, that is, the fact that they cannot pass each other, is what holds the borders 10 and 11 together.

In assembled relationship, it is obvious from FIG. 9 that there are two parallel series of pins 15, the spaces between the heads and tails of adjacent pins in each series being sufficient to permit the series to flex as a whole. However, the distance between the heads and tails of adjacent pins in each series, is sufficiently small that each pin is retained in place by its neighbors. The pins at the head of the line have their heads directed toward the prow of the boat, and so do not tend to work loose.

It will also be evident that the two series of pins along each outer edge of the boat, provide in effect flexible armoring for the boat, which protect the more vunerable portions of the boat against abrasion and shocks from fixed objects in the water.

The second aspect of the invention is the mounting of the rigid stern which supports the outboard motor. The stern constitutes a rigid panel 8 which, in addition to supporting the outboard motor, also provides one of the side walls of the boat hull and can be seen in greater detail with reference to FIGS. 13 to 19.

Figure 17:
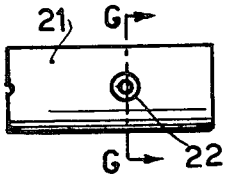
FIG. 17 is an elevational view of one of the cylindrical blocks that fits in the ends of the rigid panel.
Figure 18:
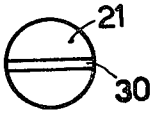
FIG. 18 is a left end view of the block shown in FIG. 17.
Figure 19:
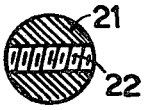
FIG. 19 is a cross-sectional view on the line G—G of FIG. 17.
Figure 20:
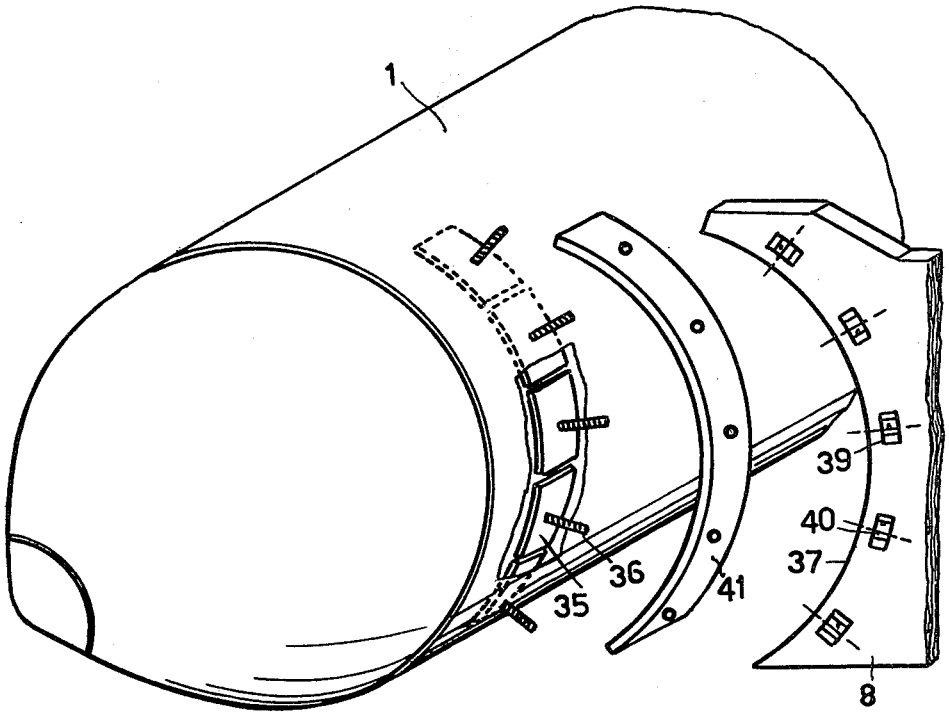
FIG. 20 is a view similar to FIG. 13, but showing another embodiment of means for mounting the rigid panel.

The stern thus comprises an upright panel 8 of generally horizontally elongated rectangular configuration, having its opposite ends concave on a circular arc at 20 of about the same radius of curvature as the inflated air chambers 27 within the envelope. Adjacent the edge of the concavity 20 are five cylindrical holes in each of which is rotatably disposed a metal cylinder 21. Each cylinder 21 has an internally screw-threaded hole 22 diametrically therethrough, as best seen in FIGS. 17 and 19.

Figure 13:
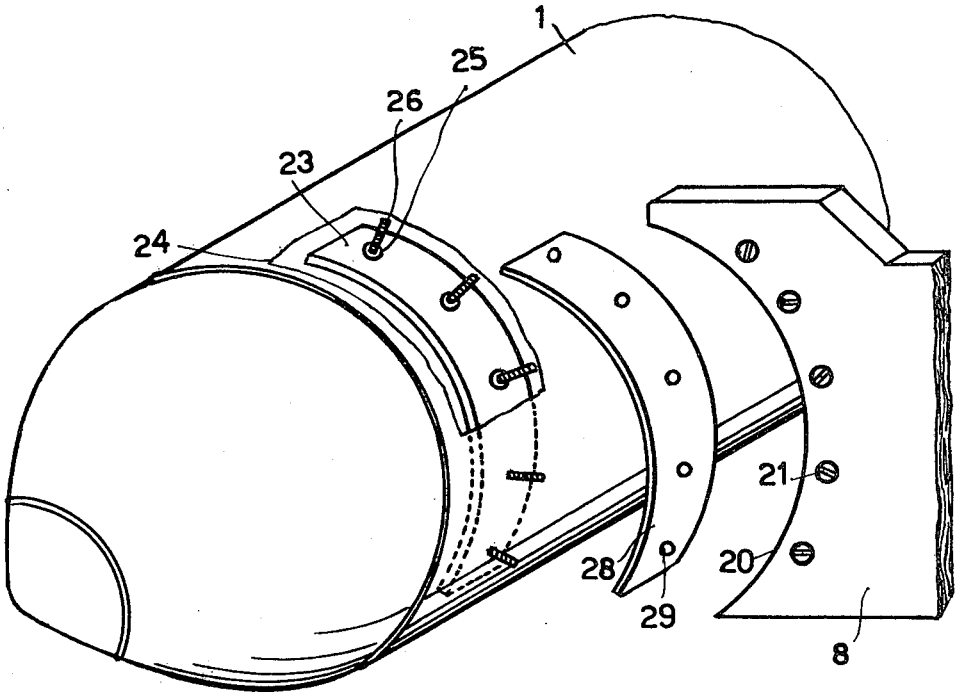
FIG. 13 is a fragmentary exploded perspective assembly view of the mounting means for the rigid panel to support an outboard motor.
Figure 14:
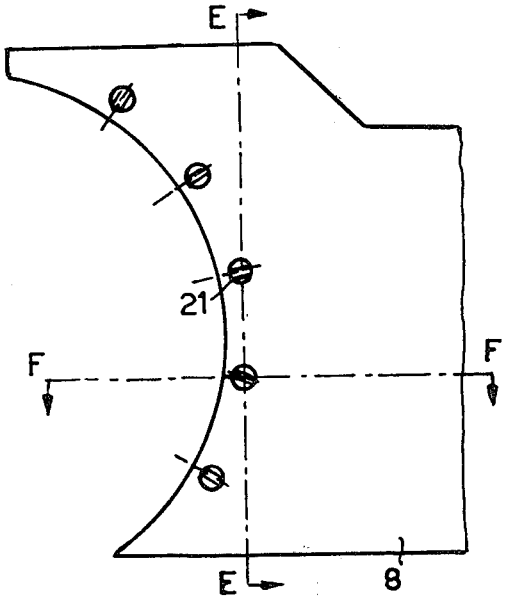
FIG. 14 is a fragmentary view of one end of the rigid panel.
Figure 15:
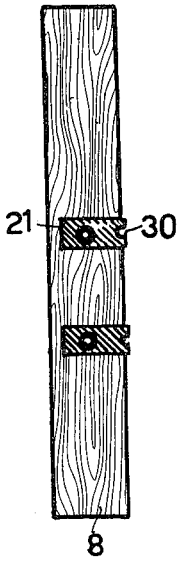
FIG. 15 is a cross-sectional view on the line E—E of FIG. 14.
Figure 16:
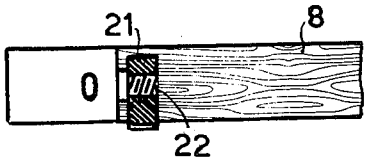
FIG. 16 is a cross-sectional view on the line F—F of FIG. 14.

Inside the inflatable structure, at each end of stern 8, is an arcuate metal strap 23 which is seen exposed through the broken-away region 24 in FIG. 13. Holes 25 extend through strap 23; and the shank of a screw 26 extends radially outwardly through each hole 25, the heads of the screws (not shown) being countersunk within strap 23.

To assemble the structure shown in FIGS. 13–19, a screwdriver is inserted in the slot 30 of each cylindrical block 21 and rotated until the screw-threaded hole 22 is radially disposed relative to the inflatable structure, that is, in alignment with an associated screw shank 26. A heavy strip 28 of rubber or the like, with holes 29 therethrough to accommodate screws 26, is then placed over the screws 26; and then the screws 26 are inserted into the holes 22 and turned by a screwdriver working on the inside of the sheathing. Obviously, this is done when the air chambers 27 are removed or at least deflated. The screws 26 are thus rotated until the stern 8 is firmly clamped to the strap 23 with the resiliently deformable strip 28 compressed in the manner of a sandwich, this latter strip serving in effect as a lock washer to maintain tension in screws 26 to keep them from loosening.

Needless to say, this assembly is effected at both ends of stern 8.

A modified construction is shown in FIGS. 20–24, with which it is possible to work entirely outside the inflatable structure. This latter embodiment can therefore be assembled when inflated.

According to this second embodiment, a sheet of material having its marginal edges 32, 33 and 34 secured to the inside of the cover of the inflatable structure, houses between itself and the inflatable structure a series of small metallic plates 35 which are rectangular as seen in FIG. 23 but which have generally the curvature of the inflated structure as seen in FIG. 22. Integral with each of these is a screw-threaded shank 36 which does not turn relative to plate 35 and which extends through corresponding holes in the circular profile 37 of the adjacent end of panel 8. These holes terminate in holes 39 which pass entirely through panel 8 and each of which houses a knurled nut 40 that engages on and tightens down on each shank 36, to tighten the small plates 35 and the panel 8 together, with rubber strip 41 interposed therebetween in the manner of a lock washer. It will be of course realized that the tendency of the plates 35 to rotate with the screw shanks 36 as the nuts 40 are turned down, is resisted by the enclosure of these plates 35 within the pocket defined between edges 32, 33 and 34.

Figure 25:
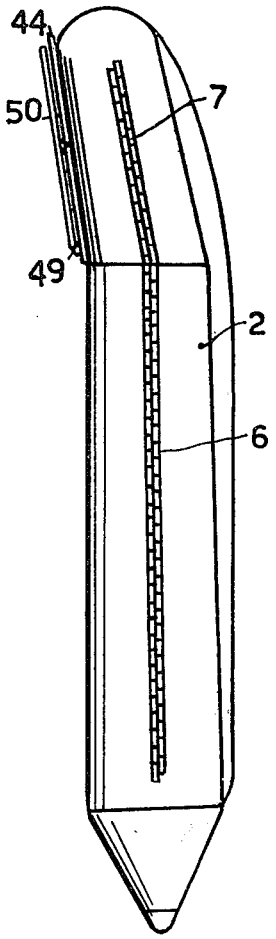
FIG. 25 is a side elevational view of the embodiment shown in FIG. 24.
Figure 24:
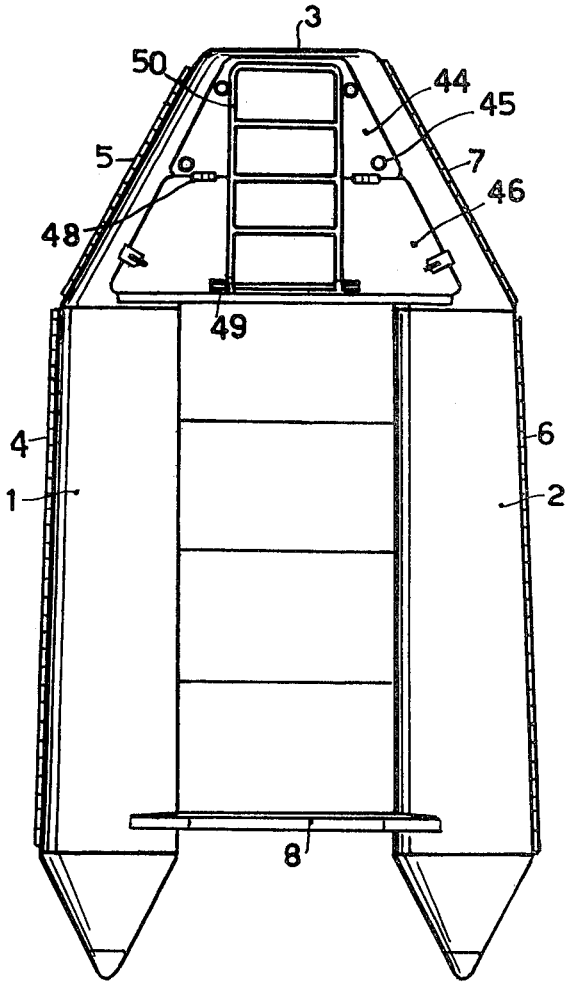
FIG. 24 is a top plan view of a modified form of the invention, showing the platform and short ladder.
Figure 26:
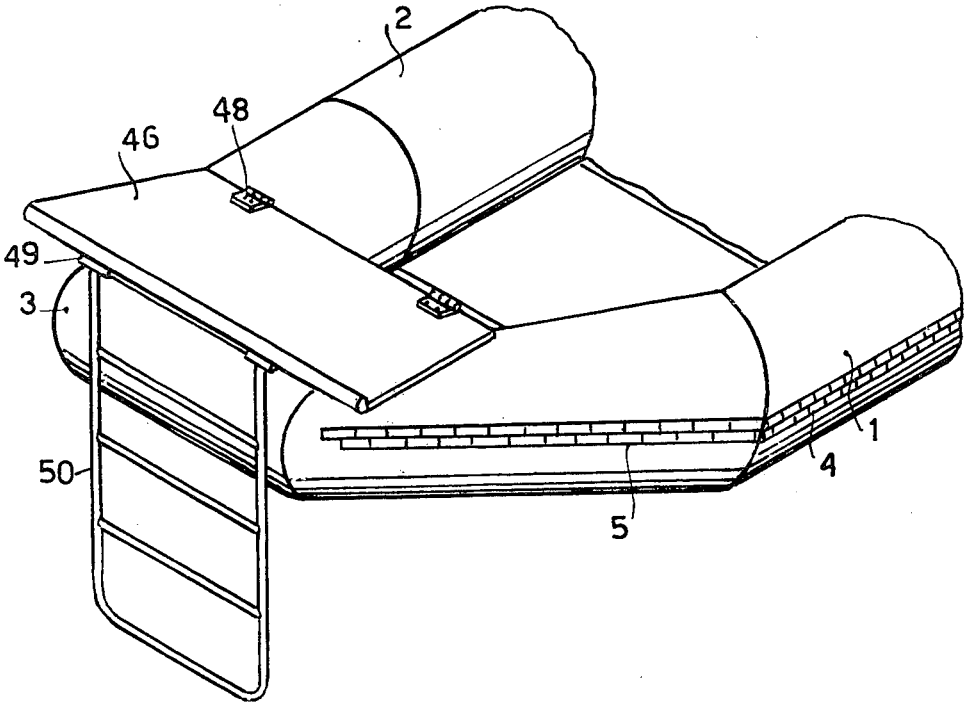
FIG. 26 is a fragmentary perspective view of the embodiment shown in FIG. 24, with the ladder lowered.

Turning now to FIGS. 24–26, the structure at the prow of the boat will be considered. As is seen in those three figures, a prow panel 44 of about the same shape as the prow is secured to the inflatable structure by four bolts 45 whose heads are fixedly secured within the envelope. A second panel 46 is hingedly connected to panel 44 by hinges 48; and a ladder 50 is connected at one end to the edge of panel 46, at 49, which is remote from hinges 48.

FIGS. 24 and 25 show the collapsed position of the ladder 50. FIG. 26 shows its use position. In the use position, the panel 46 is folded over panel 44 and ladder 50 is lowered to serve as a diving ladder or otherwise to provide access to and from the boat. In the position of FIGS. 24 and 25, however, it will be appreciated that the panels 44 and 46 together constitute a type of deck, which provides seating or other support for passengers and protection for gear stored below the deck thus provided.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. An inflatable boat comprising a pair of elongated side portions of flexible material with at least one inflatable air chamber within each side portion, and at the stern of the boat a rigid panel for supporting an outboard motor, and screw-threaded means acting between the flexible material and the panel to hold said side portions at opposite ends of said panel, said screw-threaded means comprising at least one arcuate strap, means mounting said arcuate strap on said side portion against rotation relative to said side portion, said screw means including screws that project radially outwardly through said flexible material from said at least one strap, and means on said panel to receive said screws.

2. A boat as claimed in claim 1, said means on said panel comprising cylindrical blocks whose axes extend lengthwise of the boat and that are rotatable in the panel and have screw-threaded openings for receiving said screws.

3. A boat as claimed in claim 1, said screw-threaded means comprising holes extending radially through said panel parallel to said screws, said holes terminating in further holes that extend parallel to the length of the boat, and nuts in said further holes which engage on the ends of said screws when said screws are inserted into said radially extending holes.

4. A boat as claimed in claim 1, said at least one strap comprising a single metal strap.

5. A boat as claimed in claim 1, said at least one strap comprising a strap individual to each said screw.

6. A boat as claimed in claim 1, said at least one arcuate strap being disposed inside said flexible material but outside said at least one inflatable air chamber.

* * * * *